US005222266A

United States Patent [19]

Watson et al.

[11] Patent Number: 5,222,266

[45] Date of Patent: Jun. 29, 1993

[54] PROCESS AND APPARATUS FOR THE SPACE DYEING OF HANKS OF FIBRE OR YARN

[75] Inventors: Ian E. Watson, Dannevirke; Geoffrey Hodds, Wainuiomata, both of New Zealand

[73] Assignee: BTR Operations NZ Limited, Auckland, New Zealand

[21] Appl. No.: 748,279

[22] Filed: Aug. 21, 1991

[30] Foreign Application Priority Data

Sep. 11, 1990 [NZ] New Zealand ..... 235254

[51] Int. Cl.[5] ..... D06B 15/02

[52] U.S. Cl. ..... 8/149.1; 8/151.2; 68/5 D; 68/22 R

[58] Field of Search ..... 68/5 D, 5 E, 22 R, 205 R; 8/149, 149.1, 151, 151.2

[56] References Cited

U.S. PATENT DOCUMENTS

| | | | |
|---|---|---|---|
| 3,667,258 | 6/1972 | Newton | 68/205 R |
| 3,943,734 | 3/1976 | Fleissner | 68/5 D |
| 4,005,230 | 1/1977 | Fleissner | 8/149.1 X |
| 4,433,811 | 2/1984 | Godfrey | 68/205 R X |

*Primary Examiner*—Philip R. Coe
*Attorney, Agent, or Firm*—Young & Thompson

[57] ABSTRACT

A process for the space dyeing of yarn (particularly yarn containing at least 10% of natural fibres) suitable for use in carpets, the manufacture of textiles and for hand knitting, involves a series of nozzles across the path of a conveyor carrying transverse hanks of yarn, applying sequential bands of colored dye along the transverse length of the yarn, passing the yarn through a first squeeze head to cause the dye formulation to spread on and penetrate into the yarn, fixing the dye, and passing the yarn between pressure rolls to remove sufficient of the moisture quickly so that no subsequent cross-staining of the yarn occurs. Successive pairs of pressure rolls are preferably used.

7 Claims, 1 Drawing Sheet

PROCESS AND APPARATUS FOR THE SPACE DYEING OF HANKS OF FIBRE OR YARN

FIELD

This invention relates to a process and apparatus for the space dyeing of hanks of fibre or yarn, and has particular application to fibre or yarn containing natural fibre such as wool, mohair or other.

In particular this invention relates to a process and apparatus whereby the fibre or yarn is dyed in such a way that bands of different colours are formed sequentially along it. This type of dyeing will be referred to hereafter as space dyeing.

BACKGROUND

Space dyeing of fibre or yarn is a particularly attractive way of producing fibre or yarn for many purposes, such as for the production of carpets or textiles, and for use in hand and machine knitting.

Although the desirability of producing the space dyed fibre or yarn has long been recognised there has in the past been particular technical difficulties in producing it economically in commercial quantities. In particular, when wool has been a component of the yarn and when the yarn has to be suitable for the preparation of carpets, there have been considerable difficulties in achieving successful penetration of dye into the yarn so that the dye colours the yarn right through and is not merely a superficial colouration. There have also been difficulties in ensuring that clean bands of colour are produced which do not overlap with each other and in the subsequent removal of moisture there have been problems with cross-staining of the product. Efforts have been made over many years to eliminate these problems, but until now no completely successful process has been devised.

STATEMENT OF INVENTION

It is an object of this invention to provide a process and apparatus which provides a successful means of space dyeing fibre or yarn, especially when it contains at least 10% of a natural fibre, or at least to provide the industry with a useful choice.

Another object of the present invention is to provide a process and apparatus for the space dyeing of hanks of natural fibre or yarn while avoiding the problem of cross-staining.

Still another object of the present invention is to provide such a process and apparatus wherein there is no need for centrifugal extraction of water following the rinsing of the dyed fiber or yarn.

The process of this invention for the space dyeing of fibre or yarn comprises passing said fibre or yarn through a means for causing said dye formulation to be applied in sequential bands of colour along the length of said fibre or yarn, passing said fibre or yarn through a means whereby said dye formulation is caused to spread on and penetrate into said fibre or yarn, fixing said dye formulations to said fibre or yarn, and passing said fibre or yarn through a pressure means to remove moisture so quickly that no subsequent cross-staining of the fibre or yarn occurs.

By removal of the moisture quickly it is envisaged that the moisture is removed by subjecting the fibre or yarn to a pressure means for no more than 5 seconds.

While it is envisaged that the dye formulation can be applied to the fibre or yarn by any suitable means it is preferred that said formulation is applied by means of a series of prearranged nozzles. Each nozzle or set of nozzles is connected to a dye formulation of a different colour. As the length of fibre or yarn passes under the nozzles the different coloured dyes are applied along its length. In a more preferred option the fibre or yarn is wound into hanks, the length of which correlates exactly with the length of the line of nozzles. As the hank passes under the nozzles, moving in a direction at right angles to them, the dyes are applied as bands of colour along the lengths of fibre or yarn that comprise the hank.

It has been found that the application of the dye formulation is especially successful if the said formulation is sprayed through the nozzles at a pressure between 8 psi and 30 psi. While the dye formulation may be applied at any suitable temperature it has been found that when the fibre or yarn comprises wool it is preferred that the said formulation be applied at between 20° C. and 25° C.

Following the application of the dye formulation said formulation is caused to penetrate into the fibre or yarn and spread into bands of colour along it. The preferred means for achieving this is by way of a squeeze head through which the fibre or yarn passes. The squeeze head is preferably one of the standard two roller type well known in the art, and in a most preferred option the squeeze head is about 1 m wide and contains two rollers of 40 cm diameter in which the top roller is made of stainless steel and the bottom roller is covered or coated with a surface suitable for holding the liquid dye formulations in place. In a preferred option the bottom roller is rubberized. When the fibre or yarn contains wool it has been found that the most successful spreading and penetration of the dye formulation is achieved when said fibre or yarn is subjected to a pressure of between 8 and 80 psi. A pressure of about 25 psi is preferred for unspun or loosely spun fibre while 60 to 80 psi is preferred for three strand yarn suitable for the production of carpets. The fibre or yarn may be passed through this squeeze head at a variety of speeds. It has been found that the preferred speed for the fibre or yarn to move through the said squeeze head varies with the nature of the fibre or yarn, and is in the range from 0.5 m/min to 4.5 m/min. When the fibre or yarn contains wool the most preferred speed is from 1.5 to 2.0 m/min.

After the penetration and spreading of the dye formulation into the fibre or yarn, the dye is fixed to said fibre or yarn. Any means of fixing the dye is envisaged in this process and fixing of dyes is well known in the art. A preferred means of fixing is to pass the fibre or yarn through a steamer comprising a series of bays. In an especially preferred option there are three bays and each is held at a temperature of about 100° C. The fibre or yarn may pass through the steamers at any speed but when the fibre contains wool it has been found that a time of between four and seven minutes in the steamer is preferred.

Following the fixing of the dye to the fibre or yarn, the fibre or yarn may then be rinsed. In a preferred means of rinsing the fibre or yarn is passed under a series of nozzles which spray said fibre or yarn with cold water.

The removal of most of the moisture from the fibre or yarn in such a manner as to ensure that no cross-staining occurs is preferably achieved by means of two squeeze heads. A first squeeze head is identical in structure to that described to effect the penetration and spreading of the dye formulation. The major moisture removal occurs in a second squeeze head which it has been found is especially successful in the case where the fibre or yarn contains wool as it enables the moisture to be removed without any of the cross-staining that occurs when other known methods of removing the moisture are employed. Furthermore the use of this squeeze head eliminates the necessity for centrifugal hydro extraction which traditionally follows the rinsing of dyed fibre or yarn; which process is expensive, labour intensive and not successful when the fibre or yarn in question contains wool, or other natural fibres. The fibre or yarn that emerges from this squeeze head is sufficiently dry that on stacking prior to the final drying step no problems are encountered with cross-staining.

This final squeeze head is preferably of the two roller type and in a most preferred option is about 1.1 m wide with rollers of circumference of about 84 cm, in which the top roller is rubberized and the bottom roller is made of stainless steel. In this most preferred option the operating pressure is between 30 and 80 psi and about 30% of any remaining moisture is removed.

Finally the fibre or yarn is dried, and any of the processes known in the art for this step of a drying process are envisaged as being incorporated in the process of this invention. However a preferred method of drying is by means of drum rollers.

The term squeeze head is well known in the art and refers to a set of two nip rollers between which the fibre or yarn may be fed. The fibre or yarn may pass between the rollers at a variety of speeds and may be subjected to a range of pressures between the nip rollers themselves.

When the fibre or yarn has most of the moisture removed quickly by means of a squeeze head it is envisaged that the fibre or yarn is subjected to the pressure of the nip rollers for no longer than 1 second.

It is envisaged that also incorporated in this invention is the apparatus suitable for use in the process as described above. The apparatus of this invention for the space dyeing of fibre or yarn comprises a means for applying bands of different coloured dye formulations along the length of said fibre or yarn, means for causing said dye formulation to spread on and penetrate into said fibre or yarn, means for fixing said dye formulation to said fibre or yarn, and pressure means which remove moisture so quickly so that no subsequent cross-staining of the fibre or yarn occurs.

Preferably the means for applying the dye formulation consists of a series of pre-arranged nozzles aligned so that bands of different coloured dye formulations can be applied sequentially across a length of fibre or yarn passing under the nozzles and at right angles to them.

Preferably the means for causing the dye formulation to spread on and penetrate into the said fibre or yarn consists of a squeeze head. In a most preferred option the squeeze head is of the two roller type where the top roller is stainless steel and the bottom roller is covered or coated with a surface suitable for holding the liquid dye formulations in place. In a preferred option the bottom roller is rubberized. Typically the squeeze head would be about 1 m wide and the rollers of diameter about 40 cm.

Preferably the means for fixing the dye to the fibre or yarn consists of a steamer which is optionally subdivided into bays. A most preferred option has three bays each kept at about 100° C.

The fibre or yarn may optionally be rinsed.

Preferably the pressure means for rinsing the fibre or yarn consists of one or more nozzles adapted to spray the fibre or yarn with cold water.

Preferably the pressure means for removing most of the moisture from the fibre or yarn without any cross-staining of the fibre or yarn is a squeeze head and a most preferred option has two squeeze heads; a first is essentially identical to that referred to above for ensuring penetration and spreading of the dye, a second is preferably a two roller squeeze head which in its most preferred form is about 1.1 m wide and has rollers of diameter about 84 cm where the top roller is rubberized and the bottom is of stainless steel.

Finally, the fibre or yarn may be dried. While any method known in the art for drying is envisaged as being suitable the fibre or yarn is preferably dried in drum driers.

DRAWING

These and other aspects of this invention, which should be considered in all its novel aspects, will become apparent from the following description, which is given by way of example only, with reference to the accompanying drawing, in which.

Figure 1:
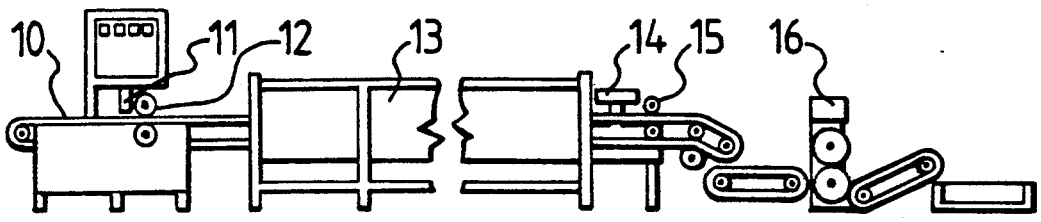
FIG. 1 is a side view of the apparatus.

With reference to FIG. 1, the fibre or yarn to be dyed is placed on the conveyor belt, 10, by which it is transported under the nozzles, 11, each delivering a stream of dye formulation. The dye formulation is then caused to spread on and penetrate into the fibre or yarn by means of the squeeze head, 12, before being taken to the steamers, 13, for fixing. The fibre or yarn is then optionally rinsed by a series of nozzles, 14, which spray cold water onto the fibre or yarn, before passing to the first of two squeeze heads, 15, for the removal of moisture. In the final step of the process the fibre or yarn passes through the squeeze head, 16, before being dried by any of the well known means.

Figure 2:
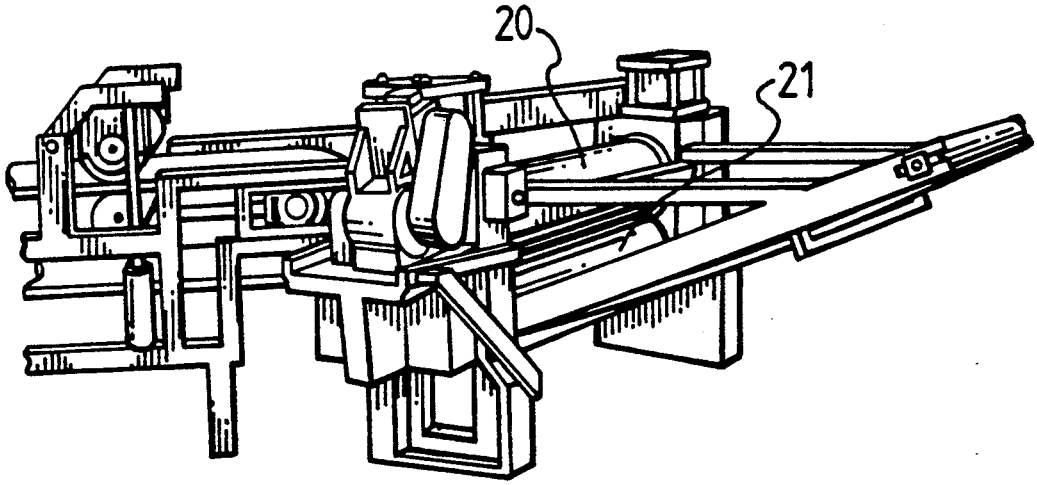
FIG. 2 is a view of the final squeeze head of the apparatus.

FIG. 2 shows in detail the structure of the second squeeze head where the top roller, 20, is rubberized and the bottom roller 21, is made of stainless steel.

While the process and apparatus of this invention is suitable for the space dyeing of all fibre or yarn it is particularly suitable for fibre or yarn containing a natural component such as wool or mohair. It is envisaged that the process is suitable for application to all types of fibre or yarn, e.g. the fibre may or may not be spun, may comprise a single thread or may have two or more strands of yarn twisted together. The fibre may be 100% natural fibre or may comprise a mixture of a natural fibre such as wool or mohair with a synthetic component such as polypropylene, acrylic, nylon, or similar.

Preferred combinations of natural fibre with a synthetic component are given as follows:

(i) 80% wool and 20% nylon; yarn having this composition is particularly suitable for the making of carpets.

(ii) 95% wool with 5% nylon binder.

(iii) 25% mohair, 70% wool and 5% nylon; yarn having this composition is suitable for hand knitting.

It is envisaged that any dye may be used in this process. However it has been found that when the fibre or yarn to be dyed contains wool many of the traditionally used dyes are not suitable for application in space dyeing. It has been found that when the fibre or yarn contains wool the preferred dyes are selected from the dye groups comprising premetallized dyestuffs and acid dyestuffs. However it is not intended that the process of this invention be limited to these dyestuffs. It has further been found that when the fibre or yarn contains wool the most successful results are achieved when a number of other chemicals are applied in conjunction with the dye. The preferred combination which follows has been found to be particularly successful for wool in this process. The preferred formulation comprises:

1. Acetic acid. The acid is used as a buffer in the formulation. A suitable pH range for the formulation is from 2.5 to 7.0 although a pH of about 5.0 is especially preferred.
2. Wetting agents. These agents aid in the penetration of the dye into the wool fibre. The preferred agent is Leophen M, available from BASF, Germany.
3. Urea. The use of urea in dye formulations as both a suspending agent and to displace heat is well known. However it has been discovered that when the fibre is wool a preferred concentration of the urea is 20 g/L.
4. Defoamer. While any suitable surface active agent is envisaged as of use it has been found that in the process of this invention defoamers of the non-silicone type are preferred. Their use eliminates the build-up of silicone deposits in the fittings and tubes of the apparatus. The most preferred defoamer when the fibre to be dyed is wool is Albegal FFA, available from Ciba-Geigy (NZ) Ltd.
5. Dye. While any dye may be used the preferred dyestuffs are those as described above.

EXAMPLES

1. Dye Formulation

The most preferred dye formulation is given, by way of example only, as follows:

| | |
|---|---|
| LEOPHEN | 0.7% |
| UREA | 2.0% |
| ACETIC ACID | 0.1% to pH = 5 |
| ALBEGAL FFA | 0.15% |

To the above composition is added any dye of the required colour. The quantity of dye added can vary, depending on the density of colour required, but is usually within the range of 0.01% to 6%. It has been found that this composition is suitable for all standard colouring situations and that it only needs to be altered if specific requirements need to be met, e.g. such as a particularly bright colour.

2. Process Details

The parameters of the process used are given for the following specific fibers and yarns, by way of example only.

TABLE

| Fiber/Yarn | 80% wool: 20% nylon | 95% wool: 5% nylon | 70% wool: 25% mohair: 5% nylon |
|---|---|---|---|
| Nozzle Pressure (psi) | 25 | 20 | 25 |
| 1st squeeze head | | | |
| Pressure (psi) | 60 | 20 | 25 |
| Speed (m/min) | 2 | 3 | 3 |
| Dye Temperature | 20° C.-25° C. | 20° C.-25° C. | 20° C.-25° C. |
| Time in steam baths | 7 min. | 4–6 min. | 4–6 min. |
| Rinse | Yes | Yes | Yes |
| DRYING: | | | |
| 1st squeeze head | | | |
| Pressure (psi) | 30 | 30 | 30 |
| Speed (m/min) | 2 | 3 | 3 |
| 2nd squeeze head | | | |
| Pressure (psi) | 60 | 60 | 60 |
| Speed (m/min) | 3 | 4 | 4 |

Finally various other alterations or modifications may be made to the foregoing without departing from the spirit and scope of the invention.

We claim:

1. In a process for the space dyeing of hanks of fibre or yarn containing at least 10% of a natural fibre, which comprises passing said hanks of fibre or yarn through a means for causing dye formulations to be applied in sequential bands of color along the length of said hanks of fibre or yarn, passing said hanks of fibre or yarn through a means whereby said dye formulations are caused to spread on and penetrate into said fibre or yarn, fixing said dye formulations to said fibre or yarn, rinsing said hanks of fibre or yarn, and drying said hanks of fibre or yarn; the improvement comprising passing said hanks of fibre or yarn quickly through pressure means after said rinsing, storing said hanks of fibre or yarn, and then carrying out final drying of the hanks of fibre or yarn, the passage of said hanks of fibre or yarn through said pressure means removing moisture so quickly that no subsequent cross-staining of the fibre or yarn occurs during said storing prior to said final drying.

2. A process as claimed in claim 1, and utilizing as said pressure means at least one squeeze head.

3. A process as claimed in claim 2, and utilizing two successive squeeze heads with no addition of moisture to the fibre or yarn between said successive squeeze heads.

4. Apparatus for the space dyeing of hanks of fibre or yarn containing at least 10% of a natural fibre, which comprises means for applying dye formulations in sequential bands of color along the length of said hanks of fibre or yarn, means for causing said dye formulations to spread on and penetrate into said fibre or yarn, means for fixing said dye formulation to said fibre or yarn and pressure means capable of removing moisture so quickly that no subsequent cross-staining of the fibre or yarn occurs.

5. Apparatus as claimed in claim 4, wherein the pressure means for removing sufficient of the moisture quickly comprises at least one squeeze head.

6. Apparatus as claimed in claim 5, wherein the pressure means for removing sufficient of the moisture quickly comprises two squeeze heads with no addition of moisture to the fibre or yarn between said squeeze heads.

7. Apparatus for the space dyeing of hanks of fibre or yarn containing at least 10% of a natural fibre, which comprises means passing said hanks of fibre or yarn through a means for causing dye formulations to be applied in sequential bands of color along the length of said hanks of fibre or yarn, means for passing said hanks of fibre or yarn through a means whereby said dye formulations are caused to spread on and penetrate into said fibre or yarn, means for fixing said dye formulations to said fibre or yarn, means for rinsing said hanks of fibre or yarn, and means for drying said hanks of fibre or yarn; the improvement comprising means for passing said hanks of fibre or yarn quickly through pressure means after said rinsing, means for storing said hanks of fibre or yarn, and means for then carrying out final drying of the hanks of fibre or yarn, the means for passing said hanks of fibre or yarn through said pressure means being adapted to remove moisture so quickly that no subsequent cross-staining of the fibre or yarn occurs during said storing prior to said final drying.

* * * * *